US010512341B2

(12) United States Patent
Goppion

(10) Patent No.: US 10,512,341 B2
(45) Date of Patent: Dec. 24, 2019

(54) MUSEUM SHOWCASE HAVING DRAWERS WITH A MOTORIZED ACTUATION SYSTEM

(71) Applicant: GOPPION S.p.A., Trezzano sul Naviglio (MI) (IT)

(72) Inventor: Alessandro Goppion, Milan (IT)

(73) Assignee: GOPPION S.P.A., Trezzano sul Naviglio (Milan) (IT)

( * ) Notice: Subject to any disclaimer, the term of this patent is extended or adjusted under 35 U.S.C. 154(b) by 0 days.

(21) Appl. No.: 15/699,326

(22) Filed: Sep. 8, 2017

(65) Prior Publication Data

US 2018/0070745 A1 Mar. 15, 2018

(30) Foreign Application Priority Data

Sep. 9, 2016 (IT) ..... 102016000091179

(51) Int. Cl.
*A47F 3/06* (2006.01)
*A47B 88/45* (2017.01)
(Continued)

(52) U.S. Cl.
CPC ..... *A47F 3/063* (2013.01); *A47B 88/457* (2017.01); *A47F 3/001* (2013.01); *A47F 3/002* (2013.01); *A47F 3/005* (2013.01)

(58) Field of Classification Search
CPC .. A47F 3/063; A47F 3/002; A47F 3/08; A47F 3/0486; A47B 88/453; A47B 88/40; A47B 88/457; A47B 88/0414; A47B 88/497; A47B 88/463; A47B 88/0477; A47B 2210/08; A47B 9/16; A47B 51/00; B66F 7/065
See application file for complete search history.

(56) References Cited

U.S. PATENT DOCUMENTS 3,282,566 A * 11/1966 Clarke ..... A47B 9/18 108/147
4,022,137 A * 5/1977 Chiu ..... E05G 1/10 109/44
(Continued)

FOREIGN PATENT DOCUMENTS

CN 203506194 U 4/2014
DE 2554920 A1 * 6/1976 ..... A47B 88/40
(Continued)

OTHER PUBLICATIONS

Search Report and Written Opinion for IT 201600091179 filed on Sep. 9, 2016 in the name of Goppion S.P.A. dated Jul. 3, 2017. 7 pages. (Italian + English Translation).

*Primary Examiner* — Andrew M Roersma
(74) *Attorney, Agent, or Firm* — Steinfl + Bruno, LLP

(57) ABSTRACT

This showcase (10) for conserving and displaying objects in a protective environment comprises a frame (20), at least one drawer (30), a pair of sliding guides (40) for each drawer (30), and a motorised actuation system (50) formed by a first arm (51) and an actuator (52). The showcase (10) with this motorised actuation system (50) makes it possible to minimise the vibrations and the sudden movements of the drawers (30) when opening and closing, hence it limits accelerations at any point of the travel, thus allowing the correct conservation of the objects displayed in the drawers (30).

8 Claims, 3 Drawing Sheets

(51) Int. Cl.
*A47F 3/00* (2006.01)
*A47B 88/457* (2017.01)

(56) References Cited

U.S. PATENT DOCUMENTS 4,577,821 A * 3/1986 Edmo ..... B66F 7/08 108/145
5,192,053 A * 3/1993 Sehlstedt ..... B66F 7/065 182/69.5
5,733,021 A * 3/1998 O'Neill ..... A47F 3/002 312/114
6,464,205 B2 * 10/2002 Wanner ..... B66F 7/065 254/122
6,540,311 B2 * 4/2003 Canedy ..... A47F 3/002 108/147
6,851,770 B2 * 2/2005 Canedy ..... A47F 3/002 312/114
7,905,560 B2 * 3/2011 Vardaro ..... A47F 3/002 312/137
8,015,638 B2 * 9/2011 Shimada ..... A47C 19/04 108/145
8,888,070 B2 * 11/2014 Olesen ..... A61G 5/1059 187/211
9,078,531 B1 * 7/2015 Medawar ..... A47F 3/002
2002/0153868 A1 * 10/2002 Takita ..... H02M 3/157 323/282
2005/0106000 A1 * 5/2005 Hogue ..... B65G 57/035 414/794.3
2014/0167574 A1 * 6/2014 Shoenfeld ..... A47B 81/00 312/215

FOREIGN PATENT DOCUMENTS

DE 9113223 U1 12/1991
DE 9307320 U1 * 10/1993 ..... A47B 88/40
DE 20206650 U1 6/2003
DE 202006011039 U1 12/2007
EP 0613852 A1 * 9/1994 ..... A47B 9/16
EP 1384697 A1 * 1/2004 ..... B66F 7/065
EP 2085556 A1 * 8/2009 ..... A47F 3/002
FR 2675486 A1 * 10/1992 ..... B65G 69/26
KR 20070004463 A 1/2007

* cited by examiner

MUSEUM SHOWCASE HAVING DRAWERS WITH A MOTORIZED ACTUATION SYSTEM

CROSS-REFERENCE TO RELATED APPLICATIONS

The present application claims priority to Italian Application No. 102016000091179 filed Sep. 9, 2016, which is incorporated herein by reference in its entirety.

FIELD

The present invention relates to a museum showcase with one or more drawers intended to be placed in an exhibition environment such as a museum, a show and the like and intended for conserving and displaying in a protected environment objects of cultural heritage, such as works of art, historic artefacts and the like by means of the drawers. Hereafter, at times the term "showcase" alone will be used; it shall always be understood to mean a museum showcase.

The term "protected environment" shall mean, here and hereafter, an environment in which the atmosphere is controlled through the monitoring of one or more parameters among temperature, humidity, dust content, pollutants content, in order to maintain the prescribed conditions of conservation of the objects on display, and in which access is denied to unauthorised personnel, to avoid theft and damages to the displayed objects.

BACKGROUND

In general, existing museum showcases comprise individual drawers that can be independent from the others and serve not only the function of conserving objects, but also making their viewing possible, albeit to a more limited extent compared to a showcase of another type, for example a display case. These showcases are used for objects that are not displayed to the public permanently, for example because they should not be excessively exposed to light or because they are included in very large collections, in which individual objects are only occasionally viewed. Moreover, the drawers can be horizontal or vertical depending on whether they are mutually superposed or set side by side. The drawers can be glass lids openable by tilting, if horizontal, or by rotation if vertical. The vertical drawers can have both sides made of glass and openable. Moreover, the drawers can also be used in composite structures, superposing on them an independent showcase body, not fastened thereto, in one of its numerous variants: with door, glass case, or table. Drawers are positioned on different types of guides, from simple ones made of metal, to telescopic ones, with high performance and with multiple extraction stages. The system for actuating showcase drawers are typically positioned in the part behind the drawer, to allow its extraction and re-insertion in the horizontal direction.

The mechanism for opening and closing the drawers of the showcase must assure that the movements of the drawers, both when opening and when closing, are gradual, i.e. smooth and gentle. With such gradual opening and closing, the objects conserved and displayed in their interior are safeguarded, protecting them from any vibrations or sudden movements. For this purpose, therefore, all drawers are provided with limit switches and braking devices which smooth out their movements. The closure of the showcase drawers can be manual or automatic.

For this purpose, in the prior art manual or motorised actuation systems are used, which assure the extraction and reinsertion of the showcase drawers.

Generally, the manual extraction and reinsertion of the drawers take place by means of metallic bar handles or retractable handles, obtained in the thickness of the front panels of the drawers; the automatic extraction and reinsertion take place through the use of specific electromechanical motors.

Hence there is the problem of using actuating systems that minimise vibrations and sudden movements of the drawers when opening and closing, hence limiting acceleration at any point of the travel, thus making these showcases compatible with the requirements for a correct maintenance of the objects conserved and displayed in the drawers.

SUMMARY

Consequently, the present invention relates to a museum showcase according to claim 1; preferred features are set out in the dependent claims.

More specifically, according to the invention, the museum showcase for conserving and displaying objects comprises a frame, at least one drawer, equipped with a transparent cover to allow the observation of the contained objects from the outside, and movable with respect to the frame, a pair of sliding guides for each drawer, arranged between the frame and the drawer, so as to define a sliding direction of the drawer in the showcase, and a motorised actuation system to move each drawer in the sliding direction with respect to the frame, characterised in that the actuation system comprises a first arm, hinged at a first end thereof with a first pin arranged on one from the frame and the drawer and constrained at a second end thereof with a sliding block at the other from the drawer and the frame, an actuator, operatively connected between the frame and the first arm to angularly move the first arm about the first pin.

By means of this actuation system, comprising a first arm and an actuator, it is possible to limit accelerations effectively at any point of the travel of the drawer as it is opened and closed. This then makes it possible to safeguard the objects conserved and displayed in the drawers against sudden movements or excessive vibrations.

Preferably the actuation system comprises a second arm hinged with the first at respective middle areas; the second arm is constrained at first end thereof with a sliding block on one from the frame and the drawer and hinged at a second end thereof with a second pin arranged on the other from the drawer and the frame.

The presence of the second arm further improves the opening movement of the showcase drawer. In detail, the first and the second arm, moving in coordination, increase the stability and the balance of the drawer when it is opened and closed, further reducing the presence of any vibration that impact the contained objects.

Preferably the first pin is arranged on the frame. More preferably the second pin is arranged on the drawer.

The aforesaid positioning of the first and of the second pin causes the movement generated by the actuator to induce the movement of the first arm with related sliding of the sliding block connected to the drawer in the second end.

Preferably, the actuator is a linear actuator, hinged at a first end thereof to the first arm in an intermediate position thereof and at a second end thereof to one from the frame and the drawer, at a third plane distanced from the first pin. This type of actuator and its location make it possible to obtain more easily the desired gradual movement of the drawer, during opening and closing.

Preferably with the drawer closed, the linear actuator of the actuation system is positioned perpendicularly with respect to the sliding direction of the drawer.

Preferably the sliding direction of the drawer is horizontal.

With the drawer closed, the aforesaid position of the linear actuator limits accelerations, so that at the beginning of the opening phase the acceleration of the drawer is substantially equal to zero, which prevents accidental damages to the conserved objects as well as to any inattentive observers who remain positioned too close to the showcase during the opening of a drawer. Moreover, this configuration assures limited dimensions, especially in terms of depth, and allows easy access to the linear actuator and to the elements of the actuation system, from the rear side of the showcase.

Preferably the opening movement of the drawer is controlled by a PLC (programmable logic controller) which transmits commands to the actuator.

More preferably the commands transmitted to the linear actuator comprise predetermined acceleration and deceleration ramps, and/or maximum speeds and/or overcurrent controls.

Thanks to the PLC, which can manage more than one drawer, acceleration and deceleration ramps are imposed on the motor to prevent accidental damages to the visitors, to assure a correct conservation of the objects and to assure the temporary arrest of the travel of the drawer and its reversibility if it meets an obstacle.

BRIEF DESCRIPTION OF DRAWINGS

Further characteristics and advantages of the invention will be more evident from the following description of a preferred embodiment of a showcase according to the invention, made with reference to the accompanying drawings. In such drawings.

DESCRIPTION

Figure 1:
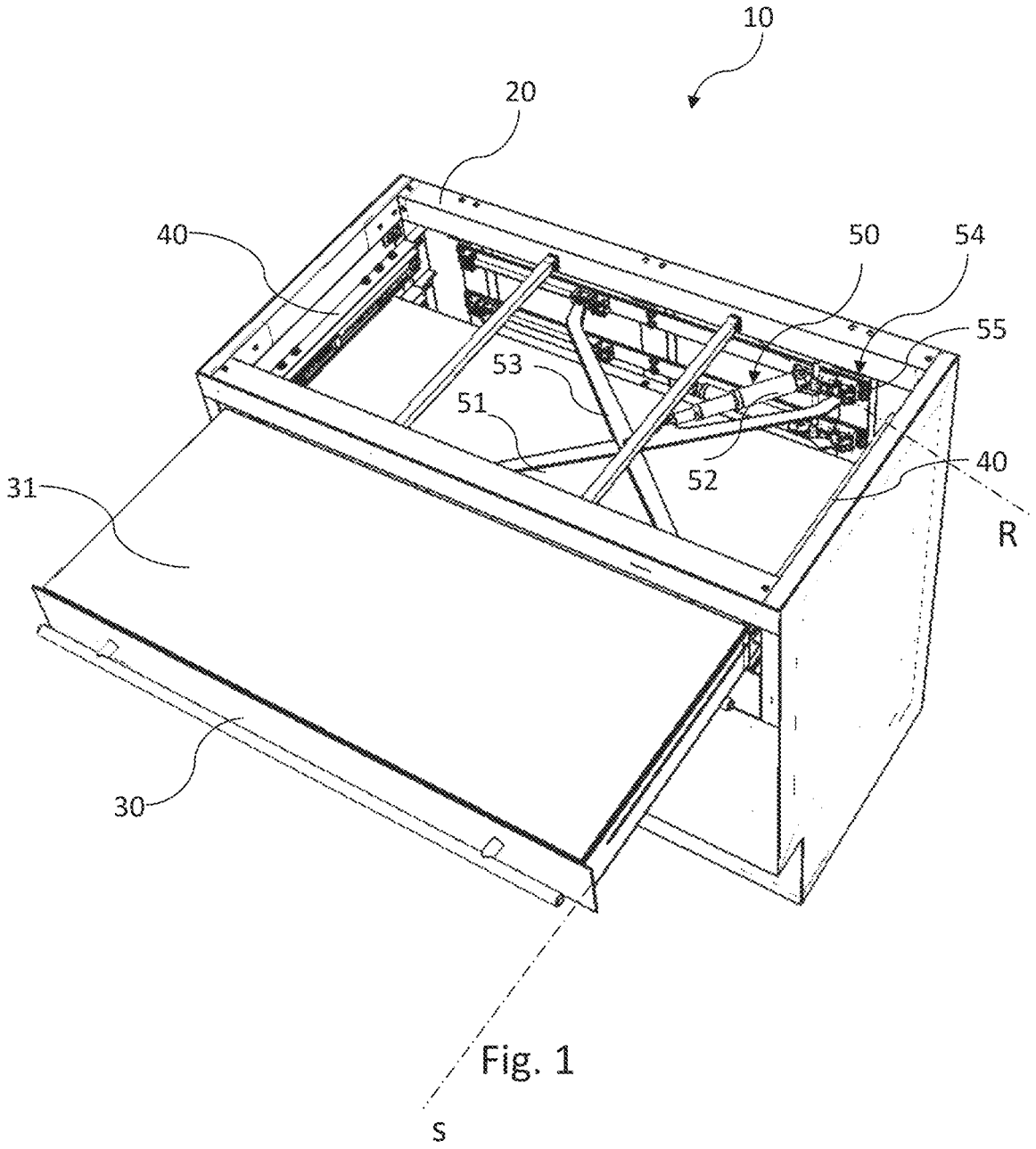
FIG. 1 is a perspective view of a showcase according to the invention.

In the figures, the numeral 10 indicates as a whole a museum showcase according to the invention. The showcase 10 comprises a frame 20, at least one drawer 30, a pair of sliding guides 40 for each drawer 30, arranged between the frame 20 and the drawer 30 so as to define a sliding direction S of the drawers 30, and a motorised actuation system 50 to move each drawer 30 with respect to the frame 20 in the direction S. The drawer is equipped with a transparent glass cover 31 to allow the observation of the objects from the outside when the drawer is open, and it is movable with respect to the frame 20, as shown in FIGS. 1 and 3.

Figure 2:
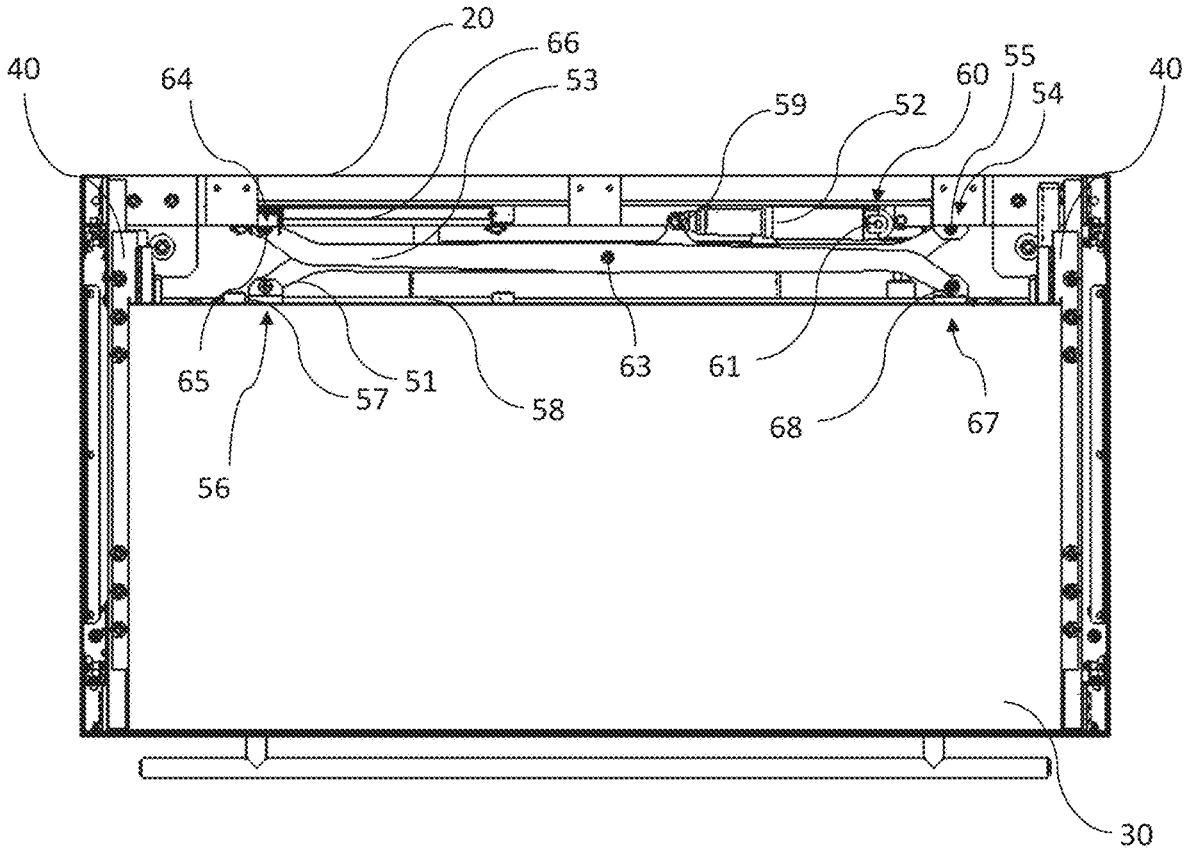
FIG. 2 is a sectioned view of the showcase of FIG. 1 with the drawers closed.
Figure 3:
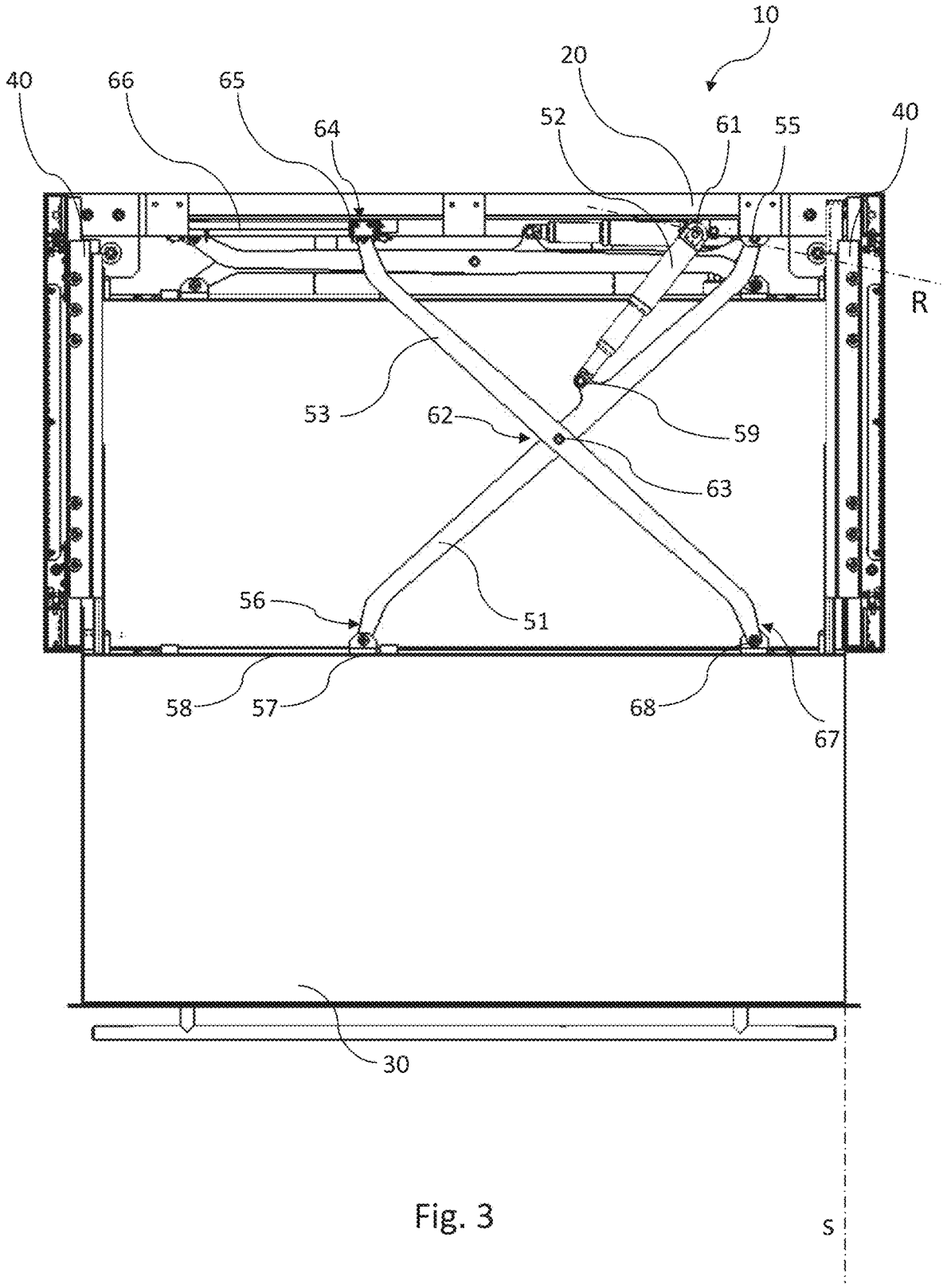
FIG. 3 is a sectioned view of the showcase of FIG. 1 with one drawer open.

With particular reference to FIGS. 2 and 3, the actuation system 50 comprises a first arm 51, a linear actuator 52 and a second arm 53. The first arm 51 is connected to the frame 20, to the drawer 30, to the linear actuator 52 and to the second arm 53 in specific points. The first arm 51 is hinged at a first end thereof with a first pin 55 arranged on the frame 20; moreover, the first arm 51 is constrained at a second end thereof 56 with a sliding block 57 to the drawer 30, posteriorly thereto. The first arm 51 is also hinged, in an intermediate position thereof, at a first end 59 of the linear actuator 52. The latter is also hinged at a second end thereof 60 with a third pin 61 fastened to the frame 20. The first pin 55 of the first arm 51 and the third pin 61 are arranged in two different points of the frame 20, distanced from each other so that—in a horizontal plane, corresponding for example to the plane of FIGS. 2 and 3—a straight line R joining the two points corresponding to the pins 55 and 61 is not perpendicular to the sliding direction of the drawer 30. The first arm 51, lastly, is hinged with the second arm 53 at respective middle areas 62 by means of a fourth pin 63. The second arm 53, like the first arm 51, is connected to the frame 20 and to the drawer 30. At a first end thereof 64, the arm 53 is constrained with a sliding block 65 to the frame 20, and the sliding block 65 is free to slide on a guide 66 connected directly to the frame 20. The second arm 53 is hinged at a second end thereof 67 to a second fixed pin 68 arranged on the drawer 30.

With the drawer 30 of the showcase 10 closed, the actuation system 50 has the configuration of FIG. 2. The linear actuator 52 is in retracted position and is perpendicular to the sliding direction S of the drawer 30, with its first end 59 oriented towards the sliding block 65 to which the second arm 53 is constrained. In the same way, the first arm 51 and the second arm 53, hinged to each other, are closed and mutually superposed parallel to the linear actuator 52 which is hinged to the first arm 51. Moreover, the drawer 30, inasmuch as it is in the closed position, is fully inserted in the pair of guides 40 on which it slides when opening and closing.

With the drawer 30 of the showcase 10 open, the actuation system 50 has the configuration of FIG. 3. The first arm 51 and the second arm 53, hinged at the respective middle areas 62, assume an "X"-shaped configuration. The linear actuator 52, in elongated configuration, is no longer positioned in perpendicular direction to the horizontal sliding direction of the drawer 30, but is inclined (by approximately 45°) with respect to the latter sliding direction.

The elements constituting the actuation system 50 move simultaneously both when opening and when closing the drawer 50 of the showcase 10. The movement determined by the actuation system entails the horizontal sliding of the first arm 51 and of the second arm 53 along the pairs of guides 40, determining the extraction and the reinsertion of the drawer 30. The sliding of the two arms is activated by the action of the linear actuator 52, that receives the commands from a PLC i.e. a programmable logic controller. The commands transmitted comprise predetermined acceleration and deceleration ramps, maximum speeds and overcurrent controls. The acceleration and deceleration ramps considerably improve the movement of the drawer 30 and reduce sudden movements or excessive vibrations of the drawer 30. What is just been stated is obtained because at the start of the opening phase and at the end of this phase, i.e. when the drawer 30 is fully open, the transmitted accelerations are nil.

The linear actuator 52 allows the opening of the drawer 30 of the showcase 10 in horizontal direction, both if the drawer of the showcase 10 is in vertical position and if the drawer 30 is in horizontal position.

When opening the drawer 30, the linear actuator 52 rotates counter clockwise and, being hinged at a first end thereof 59 to the first arm 51 in an intermediate position thereof, determines the movement of the first arm 51. The first arm 51 slides with the sliding block 57, to which it is constrained, on the guide 58 connected to the drawer 30; simultaneously, the second arm 53 also slides with the sliding block 65, to which it is constrained, on the guide 66 directly connected to the frame 20. In this way, the opening of the drawer 30 of the showcase 10 takes place. Obviously, it all takes place automatically, at the observer's command through a pushbutton (or another command device, of any type, e.g. a physical or virtual keyboard) which starts the entire mechanism.

It should be noted that the positioning of the linear actuator 52, posteriorly to the drawer 30, allows easy access thereto especially from the rear (in addition to from below, from above and from the sides), for maintenance or repair work, as well as to disengage the actuator if it does not function and if the drawer is to be operated manually.

The invention claimed is:

1. A museum showcase for conserving and displaying objects comprising:

a frame having a substantially rectangular shape defining a horizontal direction and a vertical direction of the showcase;

a plurality of horizontal drawers, each said drawer provided with a transparent cover to allow observation of contained objects from outside, and movable with respect to the frame;

a pair of horizontal sliding guides for each said drawer, arranged between the frame and sides of the drawer, so as to define a horizontal sliding direction of the drawer in the showcase;

a motorised actuation system to move each said drawer in the sliding direction with respect to the frame, said motorised actuation system comprising:

a first arm, hinged at a first end thereof to a first pin arranged on a first one among the frame and the drawer and constrained at a second end thereof to a sliding block at a second one among the frame and the drawer; and a linear actuator, operatively connected between the frame and the first arm to angularly move the first arm about the first pin, the linear actuator being hinged: i) at a first end thereof to the first arm in an intermediate position thereof and ii) at a second end thereof to the first one among the frame and the drawer, at a third pin distanced from the first pin, and wherein, with the drawer closed, the linear actuator is positioned perpendicularly with respect to the horizontal sliding direction of the drawer.

2. The museum showcase according to claim 1, wherein:

the actuation system comprises a second arm;

the first and the second arm are hinged together at respective middle areas;

the second arm is constrained at a first end thereof to a sliding block on a first one among the frame and the drawer and hinged at a second end thereof to a second pin arranged on the second one among the frame and the drawer.

3. The museum showcase according to claim 1, wherein the first pin is arranged on the frame.

4. The museum showcase according to claim 2, wherein the second pin is arranged on the drawer.

5. The museum showcase according to claim 1, wherein opening movement of the drawer is controlled by a programmable logic controller connected to the actuator to transmit commands to the actuator.

6. The museum showcase according to claim 5, wherein the commands transmitted to the actuator comprise predetermined acceleration and deceleration ramps, and/or maximum speeds and/or overcurrent controls.

7. A museum showcase for conserving and displaying objects comprising:

a frame having a substantially rectangular shape defining a horizontal direction and a vertical direction of the showcase;

a plurality of horizontal drawers, each said drawer provided with a transparent cover to allow observation of contained objects from outside, and movable with respect to the frame;

a pair of horizontal sliding guides for each said drawer, arranged between the frame and sides of the drawer, to define a horizontal sliding direction of the drawer in the showcase;

a motorised actuation system to move each said drawer in the sliding direction with respect to the frame, said motorised actuation system comprising:

a first arm, hinged at a first end thereof to a first pin arranged on a first one among the frame and the drawer and constrained at a second end thereof to a sliding block at a second one among the frame and the drawer, the first arm comprising a straight central section and two end sections bent in opposing directions; and a linear actuator, operatively connected between the frame and the first arm to angularly move the first arm about the first pin, the linear actuator being hinged: i) at a first end thereof to the first arm at a lateral projection thereof, located in an intermediate position thereof, and ii) at a second end thereof to the first one among the frame and the drawer, at a third pin distanced from the first pin; and wherein, with the drawer closed:

the linear actuator is positioned perpendicularly with respect to the horizontal sliding direction of the drawer.

8. A museum showcase for conserving and displaying objects comprising:

a frame having a substantially rectangular shape defining a horizontal direction and a vertical direction of the showcase;

a plurality of horizontal drawers, each said drawer provided with a transparent cover to allow observation of contained objects from outside, and movable with respect to the frame;

a pair of horizontal sliding guides for each said drawer, arranged between the frame and sides of the drawer, so as to define a horizontal sliding direction of the drawer in the showcase;

a motorised actuation system to move each said drawer in the sliding direction with respect to the frame, said motorised actuation system comprising:

a first arm, hinged at a first end thereof to a first pin arranged on the frame and constrained at a second end thereof to a sliding block at the drawer; and a linear actuator, operatively connected between the frame and the first arm to angularly move the first arm about the first pin, the linear actuator being hinged: i) at a first end thereof to the first arm in an intermediate position of the first arm, and ii) at a second end thereof to the frame, at a second pin distanced from the first pin and in proximity of the first pin, so that during actuation of the actuator a first angular movement of the first arm about the first pin and a second angular movement of the actuator about the second pin is in a same angular direction and in a same plane.

* * * * *